US007293834B2

(12) United States Patent
Riach et al.

(10) Patent No.: US 7,293,834 B2
(45) Date of Patent: Nov. 13, 2007

(54) ARTICULATING TABLE

(75) Inventors: Jeffrey M. Riach, Cockeysville, MD (US); James E. Hollingshead, Felton, PA (US); Dave J. Wilston, Etters, PA (US); Bryan K. Anderson, Windsor, PA (US)

(73) Assignee: Oakworks, Inc., Shrewsbury, PA (US)

( * ) Notice: Subject to any disclaimer, the term of this patent is extended or adjusted under 35 U.S.C. 154(b) by 0 days.

(21) Appl. No.: 11/110,946

(22) Filed: Apr. 21, 2005

(65) Prior Publication Data

US 2006/0001296 A1 Jan. 5, 2006

Related U.S. Application Data

(60) Provisional application No. 60/563,807, filed on Apr. 21, 2004.

(51) Int. Cl.
*A47C 1/00* (2006.01)
*A61G 15/00* (2006.01)

(52) U.S. Cl. ..... 297/330; 297/68

(58) Field of Classification Search ..... 297/68, 297/118, 119, 130, 330, 452.27, 344.12, 344.15, 297/344.16, 344.17

See application file for complete search history.

(56) References Cited

U.S. PATENT DOCUMENTS 3,093,410 A * 6/1963 Wilson ..... 297/119
3,159,423 A * 12/1964 Gilbert ..... 297/119
3,254,916 A * 6/1966 Bass ..... 297/140
3,964,786 A * 6/1976 Mashuda ..... 297/330
4,168,099 A * 9/1979 Jacobs et al. ..... 297/330 X
4,183,578 A * 1/1980 Naganawa ..... 297/330
4,330,151 A * 5/1982 Healey ..... 297/158.3
D265,242 S 6/1982 Patterson
4,392,685 A * 7/1983 Leonhart ..... 297/119
D301,612 S 6/1989 Masuda et al.
D334,982 S 4/1993 Riach
5,390,384 A * 2/1995 Dinsmoor et al. ..... 297/452.27
5,401,078 A 3/1995 Riach
5,645,313 A * 7/1997 Best et al. ..... 297/330
D409,751 S 5/1999 Kemp
5,943,965 A 8/1999 Riach et al.
6,192,809 B1 2/2001 Riach et al.
6,565,112 B2 * 5/2003 Hanson et al. ..... 297/344.15
D511,834 S 11/2005 Riach
2003/0033675 A1 2/2003 Solesbee et al.

OTHER PUBLICATIONS

Jeffrey M. Riach, "Sloped Table Top and A Table Having A Sloped Table Top", U.S. Appl. No. 11/019,679, filed Dec. 23, 2004.

* cited by examiner

*Primary Examiner*—Anthony D. Barfield
(74) *Attorney, Agent, or Firm*—Tim L. Brackett, Jr.; Nixon Peabody, LLP

(57) ABSTRACT

An articulating table including a back rest section, a seat section, and an articulation mechanism that adjusts the position of at least the back rest section and the seat section to configure the table between the substantially flat table configuration and the chair configuration. The articulating table preferably includes a foot rest section, and at least one hinge that pivotally connects the foot rest section to the seat section so that the foot rest section is pivotable about the hinge.

14 Claims, 23 Drawing Sheets

ARTICULATING TABLE

This application claims priority to U.S. Provisional Application No. 60/563,807, filed Apr. 21, 2004, the contents of which are incorporated herein by reference.

BACKGROUND OF THE INVENTION

1. Field of the Invention

The present invention is directed to a table that also articulates to provide various sitting and/or reclining positions.

2. Description of Related Art

Various different tables are used in the massage and physical therapy services industry as well as in other medical services industry. Generally, such tables are provided with a cushioned surface for comfortably supporting the client or patient. One example table used in the massage and physical therapy services industry is disclosed in U.S. Pat. No. 5,943,965 to J. Riach which is assigned to the assignee of the present application. This reference discloses an improved collapsible folding massage table with four folding leg assemblies having improved folding and stabilizing features. The collapsible foldable table disclosed also includes integral hinges that hingedly attaches two table top sections and also include provisions for attaching members of the folding leg braces. U.S. Pat. No. D334,982 also assigned to the assignees of the present application discloses an ornamental design for a contoured top for a medical examination table.

Many services provided by therapists and other professionals are rendered with the client/patient in the seated position. For example, U.S. Pat. No. 5,401,078 to L. Riach and assigned to the assignees of the present invention discloses a unitary, portable, foldable and adjustable therapy chair that is adjustable from a collapsed position to a plurality of erect positions. Such an adjustable chair allows the position of the client/patient to be adjusted. Another examples include dentist's chair which are typically in the reclined configuration so that the dentist rendering dental services can gain easy access to the patient's teeth while sitting down.

With many clients/patients, especially the elderly and the handicapped, laying down on a table can be difficult due to their physical limitations. In addition, getting in and out of a chair can also be difficult. These difficulties are compounded if the client/patient needs to be in both positions (laying down and sitting) during the course of receiving their services or treatment. Therefore, there exists an unfulfilled need for an articulating table that can be configured for use as a chair. There further exists an unfulfilled need for such an articulating table that facilitates ingress and egress.

SUMMARY OF THE INVENTION

The articulating table in accordance with the present invention is implemented to allow the therapist and the client to maximize their ergonomics and comfort in a wide range of positions. The articulating table may be configured into a chair or a recliner, in addition to a table having a substantially flat, planar surface. It is envisioned that the articulating table of the present invention will be used in spas, massage therapy practices, various medical practices including dental, in rehabilitation environments where limited mobility of patients is an issue, as well as other appropriate applications.

In accordance with one embodiment, the articulating table of the present invention includes two independently controllable lifting devices. These lifting devices allow the sections of the table to be angled relative to the floor. This functionality is useful in helping the client get off the chair to a standing position since the chair can be tilted forward and lift as the client tries to stand. In addition, this feature also allows the articulating table to be tilted when in a table configuration or a chair configuration so as to allow a more ergonomic positioning of the client.

In the table configuration, access to the ends of the articulating table are facilitated for better ergonomics. In this regard, in accordance with one embodiment, the back rest section of the articulating table is angled or tapered at the head end to allow a therapists to work on clients, while being seated with good ergonomics for the therapists' shoulders. In another embodiment, at the foot end of the articulating table, the foot rest section has no frame so as to allow easy access for a person's legs when they are seated. The ergonomics for the therapist are maximized by allowing the therapist to sit at either end of the articulating table when in the articulating table is in a table configuration, and allows the therapist to slide their seat under the table top, thereby moving the therapist closer to the client to facilitate their work. The adjustable height feature and the ability to angle the table also facilitate ergonomic positioning.

In accordance with one embodiment, the cushion in the seat area has a multilayer foam system that is designed to help a client not slip forward or slouch when in a seated position. The lowest layer has wedge shaped and may be made of a firm foam which is thicker towards the front edge of the seat, functionally changing the angle of the seat relative to horizontal from a support point of view. An inverted wedge shaped layer may also be provided so that the overall cushion shape remains substantially the same thickness. Thus, the padding in the seat is unique in that it is design to prevent the pelvis from siding forward on the seat.

The foot rest section of the articulating table is preferably implemented to go through a 90 degree range of motion and when in a horizontal position, and be strong enough to handle the load rating of the articulating table. The foot rest section is implemented to be supported by a support member and an actuator, and preferably, is not pulled down by the actuator. By having gravity pull the foot rest down, the articulating table prevents forced interference of various mechanical components and reduces the potential for breakage of such components in certain positions.

The articulating table may also be implemented with armrests that offer flexible positioning for better client comfort and easy removal when needed. In the illustrated embodiment, the armrests rotate and lock in a plurality of different positions, and also fold up out of the way.

In accordance with one embodiment, the articulating table that is configurable between a substantially flat table configuration and a chair configuration includes a back rest section, a seat section, and an articulation mechanism that adjusts the position of at least the back rest section and the seat section to configure the table between the substantially flat table configuration and the chair configuration. In accordance with one embodiment, the articulation mechanism includes a frame member positioned underneath at least the back rest section and the seat section. In one embodiment, the articulating table further includes a base with a first lifting device and a second lifting device. The first lifting device is connected to the frame member proximate to one end of the frame member, and the second lifting device proximate to the other end of the frame member. The first lifting device and the second lifting device are controllable to adjust the height position and/or incline of the articulating table. In one embodiment of the present invention, the articulating table further includes at least one hinge that pivotally connects the back rest section and the seat section, so that the back rest section and the seat section are pivotable about the hinge. In one implementation, the hinge is fixedly secured to the frame member.

In accordance with another embodiment of the present invention, the articulating table further includes a foot rest section, and at least one hinge that pivotally connects the foot rest section to the seat section so that the foot rest section is pivotable about the hinge. Preferably, the hinge that pivotally connects the foot rest section to the seat section is a double hinge. In one implementation, the double hinge includes a first flange connected to the seat section, a second flange connected to the foot rest section, and the third flange connected to a support member that supports the foot rest section. The articulation mechanism may include an actuator that supports the foot rest section. In this regard, the articulation mechanism includes a support member connected to the actuator, the support member supporting the foot rest section when the actuator is extended. Preferably, the foot rest section is not directly attached to the support member or the actuator.

In accordance with still another embodiment, the articulation mechanism includes an actuator to control angulation of the back rest section, and a rotatable crank mechanism that is connected to the actuator and the back rest section to control angulation of the back rest section. Similarly, the articulation mechanism includes an actuator to control angulation of the seat section, and a rotatable crank mechanism that is connected to the actuator and the back rest section to control angulation of the seat section.

In accordance with another embodiment of the articulating table, the back rest section includes a table top frame having an angled support surface. In this regard, the back rest section includes a cushion that is tapered on one side to correspond to the angled support surface and having a substantially planar flat surface on an opposite side thereof. The back rest section and/or the seat section may further include a curved side member that extends from edge of the table top frame.

In yet another embodiment, the seat section includes a seat cushion having a plurality of layers. In one implementation, the plurality of layers of the seat cushion includes a wedge profiled layer, the wedge profiled layer being thicker toward an edge of the seat cushion opposite to the back rest section, and thinner toward an edge of the seat cushion adjacent to the back rest section. In this regard, the wedge profiled layer is the firmest layer of the plurality of layers, and the plurality of layers may include an inverted wedge profiled layer, the wedge profiled layer being thicker toward an edge of the seat cushion adjacent to the back rest section so as to maintain the flat, planar surface of the seat section.

In accordance with another embodiment of the present invention, the articulating table further includes arm rests that are pivotable to be substantially perpendicular to the back rest section. The articulating table may include a means for rotating the arm rests between a wide configuration and a high configuration. For instance, the arm rests may include mounting brackets secured to the back rest section, an arm rest pad and an arm rest pad support to which the arm rest pad is mounted, and an adapter bracket for connecting the arm rest pad support to the mounting brackets.

In still another embodiment of the present invention, the articulation mechanism includes at least one cross bar spanning between the frame members, at least one actuator being secured to the cross bar. The articulating table in accordance with one embodiment may further be configurable to a recliner configuration and/or positionable in a leaning forward position in the chair configuration.

In accordance with another embodiment, the present invention provides an articulating table that is configurable between a substantially flat table configuration and a chair configuration. In one embodiment, the articulating table includes a back rest section, a seat section, at least one hinge that pivotally connects the back rest section and the seat section, so that the back rest section and the seat section are pivotable about the hinge. In this embodiment, the articulating table also includes a base with a first lifting device and a second lifting device that are controllable to adjust at least one of height position and incline of the articulating table, and an articulation mechanism with a frame member positioned underneath the back rest section and the seat section, the first lifting device being connected to the frame member proximate to one end, and the second lifting device being connected to the frame proximate to another end. The articulation mechanism is operable to adjust the position of at least the back rest section and the seat section to configure the table between the substantially flat table configuration and the chair configuration.

In yet another embodiment, an articulating table that is configurable between a substantially flat table configuration and a chair configuration is provided, the articulating table including a back rest section, a seat section, at least one hinge fixedly secured to the frame member that pivotally connects the back rest section and the seat section, so that the back rest section and the seat section are pivotable about the at least one hinge. The articulating table also includes a foot rest section, a double hinge that pivotally connects the foot rest section to the seat section, the double hinge including a first flange connected to the seat section, a second flange connected to the foot rest section, and the third flange connected to a support member that supports the foot rest section, but is not attached to the foot rest section. The articulating table further includes a base with a first lifting device and a second lifting device, and an articulation mechanism with a frame member positioned underneath at least the back rest section and the seat section, the first lifting device connected to the frame member proximate to one end of the frame member, and the second lifting device proximate to another end of the frame member. The articulation mechanism is operable to adjust the position of at least the back rest section and the seat section to configure the table between the substantially flat table configuration and the chair configuration.

These and other advantages and features of the present invention will become more apparent from the following detailed description of the preferred embodiments of the present invention when viewed in conjunction with the accompanying drawings.

DETAILED DESCRIPTION OF THE PREFERRED EMBODIMENT

Figure 1:
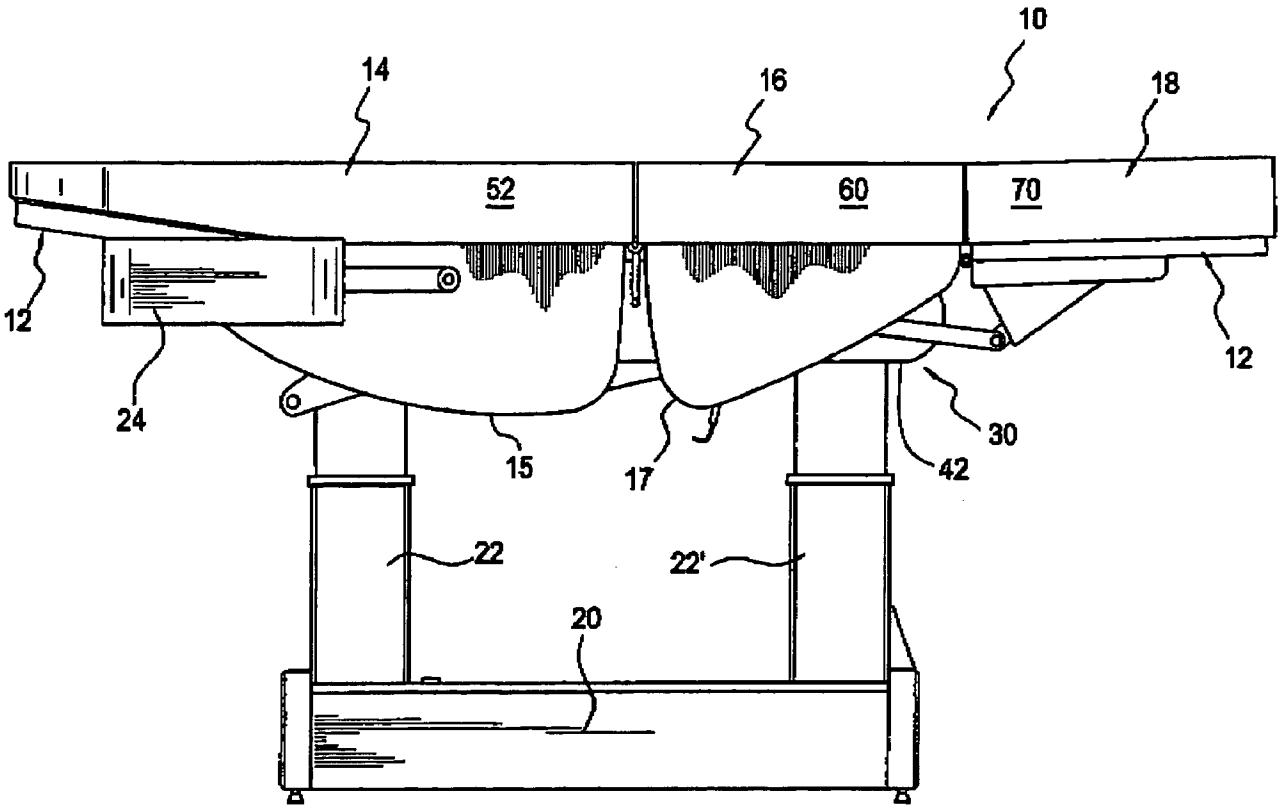
FIG. 1 is a side profile view of the articulating table in accordance with one example embodiment of the present invention.

FIG. 1 shows side profile view of an articulating table 10 in accordance with one example embodiment of the present invention. In the illustrated embodiment, the articulating table 10 is implemented with three separate sections: a back rest section 14, a seat section 16, and a foot rest section 18. Each of these sections include table top frames 12 that provide support to the corresponding padding or cushions 52, 60 and 70 respectively. The cushions 52, 60 and 70 are secured to the table top frames 12 for comfortably supporting the client utilizing the articulating table 10. In the configuration shown in FIG. 1, the articulating table 10 of the present invention provides a substantially flat surface so that the client can lay down comfortably on the cushions of the back rest section 14, the seat section 16, and the foot rest section 18.

As also clearly shown, the illustrated embodiment of the back rest section 14 and the seat section 16 are provided with optional curved side members 15 and 17, respectively. The curved side member 15 extends from the side edge of the table top frame 12 of the back rest section 14. Likewise, the curved side member 17 extends from the side edge of the table top frame (not shown) of the seat section 16. Of course, such curved side members are provided on the opposite edges (not shown) of the back rest section 14 and the seat section 16 as well. The curved side members serve to cover the various components for changing the configuration of the articulating table 10. However, in the illustrated embodiment, the foot rest section 18 is not provided with a side member to thereby enhance the access to the area underneath the foot rest section 14 so as to allow an individual, such as a massage therapist, to sit with their knees thereunder when the articulating table 10 is in the table configuration.

The articulating table 10 further includes a base 20 on which a plurality of lifting devices 22 and 22' are provided. These lifting devices may be implemented with electrical motors, actuators, rack and pinion, worm gear, scissor lift, or in any other appropriate manner to allow extension and retraction of the first lifting device 22 and second lifting device 22'. In the illustrated embodiment, the lifting devices 22 and 22' incorporate electrical motors to variably control the amount of lift of the articulating table 10. The lifting devices 22 and 22' of the illustrated embodiment are operable to change the height and angle of the articulating table 10 to thereby facilitate providing of services to the client laying on the articulating table 10. The lifting devices 22 and 22' are also operable to further configure the articulating table 10 into a chair or recliner configurations as described in further detail below.

Figure 2:
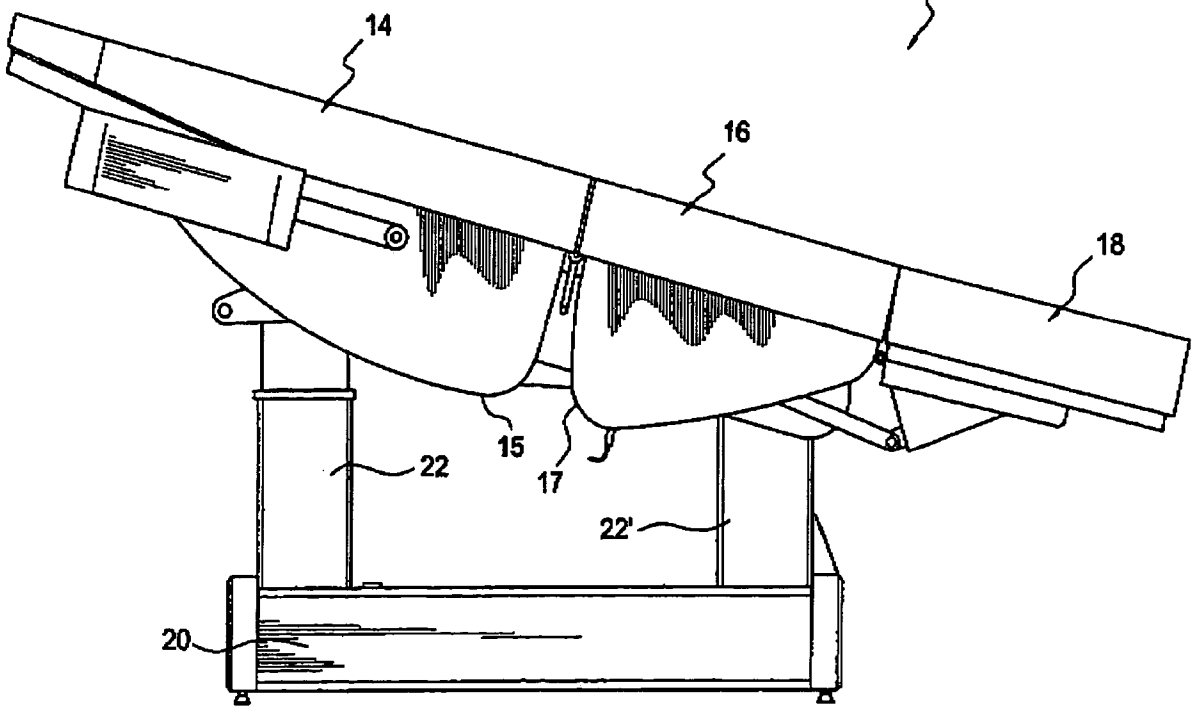
FIG. 2 is a side profile view of the articulating table of FIG. 1 in an inclined configuration.

Furthermore, the articulating table 10 includes arm rests 24 which are movable to various positions to enhance comfort of the user. The first and second lifting devices 22 and 22' are secured to an articulation mechanism 30 that is described in further detail below. The articulation mechanism 30 is provided on the underside of the table top frame 12 and operable to configure the articulating table 10 into the various configurations described. In this regard, the articulation mechanism 30 includes frame members 42 to which various components of the articulation mechanism 30 are attached. FIG. 2 shows the articulating table 10 in FIG. 1 that has been inclined by retracting (i.e. lowering) the second lifting device 22' while maintaining the height position of the first lifting device 22. This, for example, allows customized positioning of the client laying on the articulating table 10.

Figure 3:
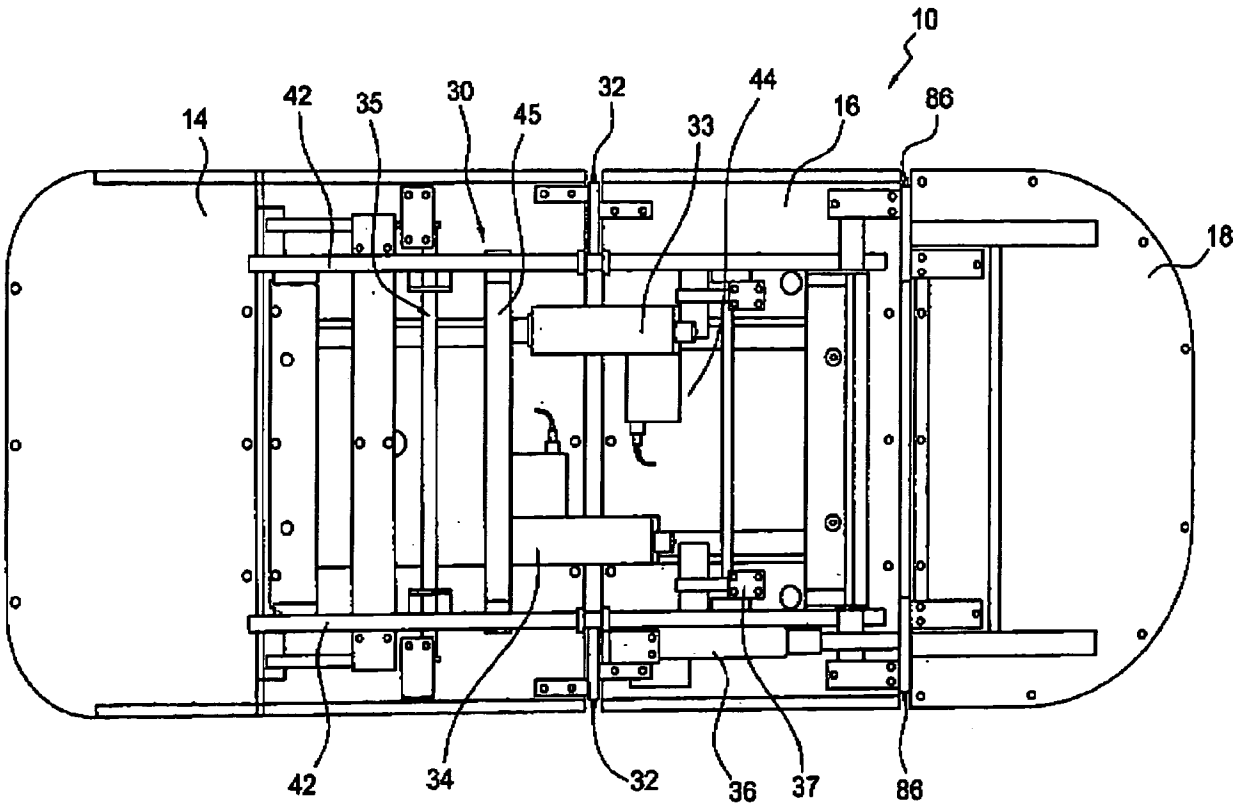
FIG. 3 is a topographical view of the articulating table of FIG. 1 with the articulation mechanism being illustrated through the table sections.

FIG. 3 shows a detailed topographical view of the articulation mechanisms 30 that allows the articulating table 10 to be configured from the table configurations shown in FIGS. 1 and 2, to a chair configuration or a recliner configuration as described in further detail below. For clarity purposes, the back rest section 12, the seat section 16, and the foot rest section 18 are illustrated transparently so as to allow various components of the articulating table 10 and the articulation mechanism 30 to be clearly viewed. The articulating table 10 includes plurality of hinges 32 that pivotally connect the back rest section 14 and the seat section 16. The hinges 32 are fixedly secured to the frame member 42. Thus, the opposite ends of the back rest section 14 and the seat section 16 can be pivoted about hinges 32. The articulating table 10 further includes plurality of hinges 86 that connect adjacent edges of the foot rest section 18 to the seat section 16 so that the foot rest 18 section can be pivoted about hinges 86.

In addition, the articulation mechanism 30 includes plurality of actuators 33, 34, and 36. As shown, the actuator 33 is mounted to a cross bar 44 between frame members 42, and is connected to the crank mechanism 35 for controlling the angulation of the back rest section 14. Actuator 34 is mounted to a cross bar 45 between frame members 42, and is connected to crank mechanism 37 for controlling the angulation of the seat section 16. Actuator 36 is mounted to the side of the frame member 42 and is connected to the foot rest section 18 for controlling the angulation of the foot rest section 18. Thus, the actuators 33 and 34 are connected to crank mechanisms as described in further detail below, and can be actuated (together with operation of the lifting devices 22 and 22') to allow configuration of the articulating table 10 into the chair or recliner configurations. Preferably, the actuators 33, 34 and 36 are electrical actuators that incorporate an electrical motor that is operable to change the extension of the actuators. In addition, as described in further detail below, the articulation mechanism 30 further includes linkages connected to the crank mechanisms that allow proper articulation of the various sections of the articulating table 10 in accordance with the present embodiment.

Figure 4:
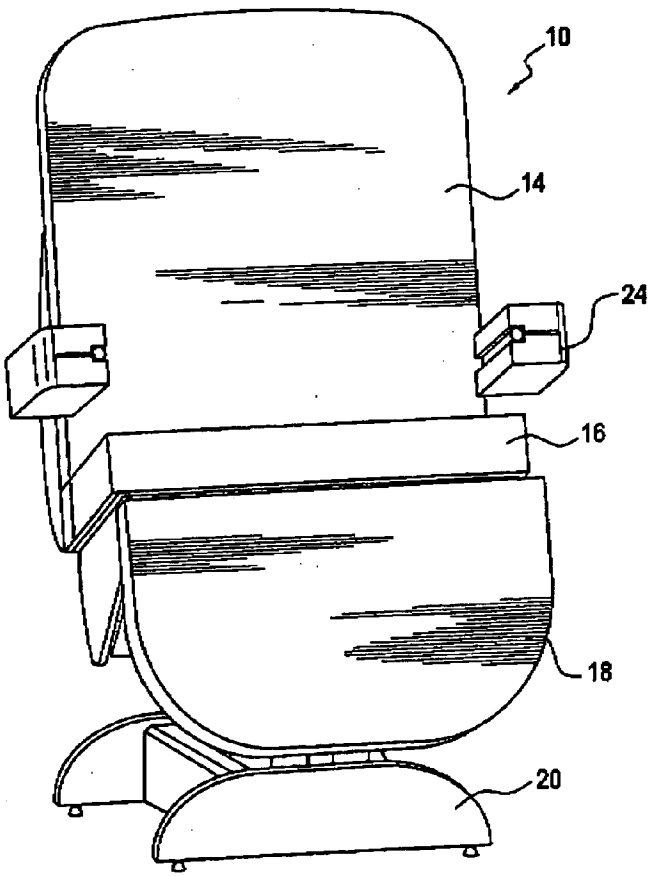
FIG. 4 is a front perspective view of the articulating table of FIG. 1 which has been converted into a chair configuration.

FIG. 4 shows the articulating table 10 of FIG. 1 which has been configured into the chair configuration. In this regard, the back rest section 14 is propped up substantially upright whereas the seat section 16 is angled slightly with the back portion being lowered, but otherwise maintaining a substantially planar position. In addition, the foot rest section 18 is rotated downward so that it is substantially perpendicular to the seat section 16. The arm rests 24 are pivoted to be perpendicular to the back rest section 14, and substantially parallel to the seat section 16 so as to allow the client to sit on the articulating table 10 with his/her arms supported on the arm rests 24.

Figure 5:
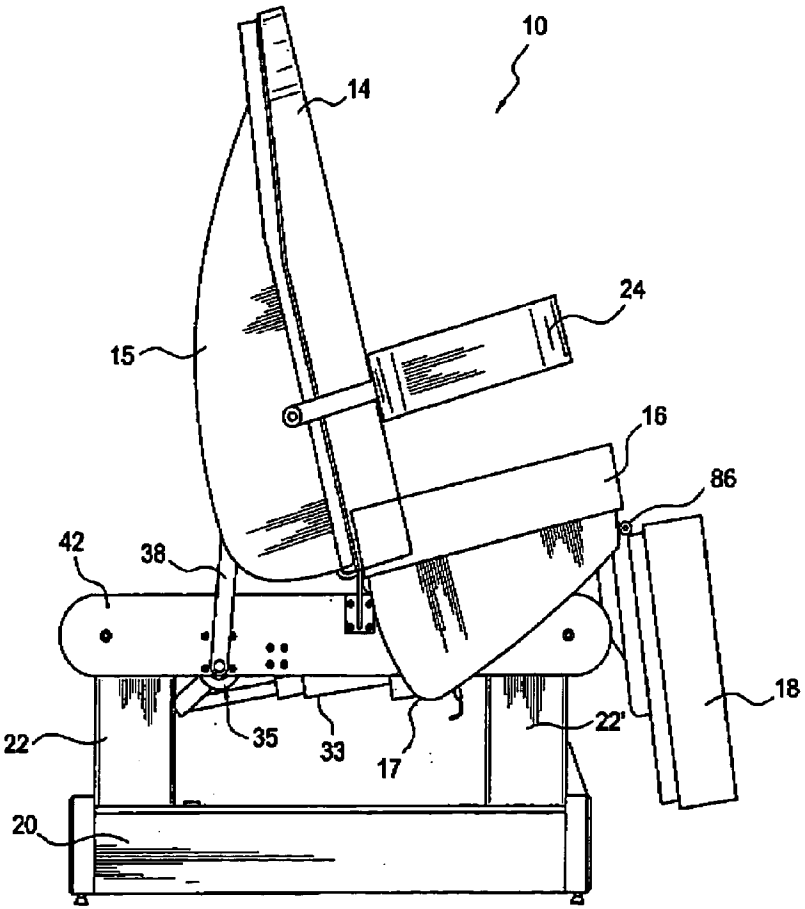
FIG. 5 is a side profile view of the table in the chair configuration of FIG. 4.

In this regard, FIG. 5 shows a side profile view of the articulating table 10 in the chair configuration shown in FIG. 4. As can be seen, the actuator 33 has been extended to rotate the crank mechanism 35, thereby causing rotation and erecting of the rod 38 that is attached to the back section 14, and causing the back rest section 14 to be erected to the position shown. Moreover, the actuator 36 shown in FIGS. 1 and 3 which supports the foot rest 18, has been retracted to allow the foot rest section 18 to pivot downward into a substantially vertical position as shown in FIG. 5. As described in further detail below, the foot rest section 18 in accordance with the illustrated embodiment is implemented to be supported by the actuator 36, but is not directly connected thereto so that the foot rest section 18 maintains the substantially vertical position shown in FIG. 6 by gravity when the actuator 36 is fully retracted. In such a configuration, the articulating table 10 allows the client to sit comfortably and be well supported for receiving of certain massage, physical therapy, or other services.

Figure 6:
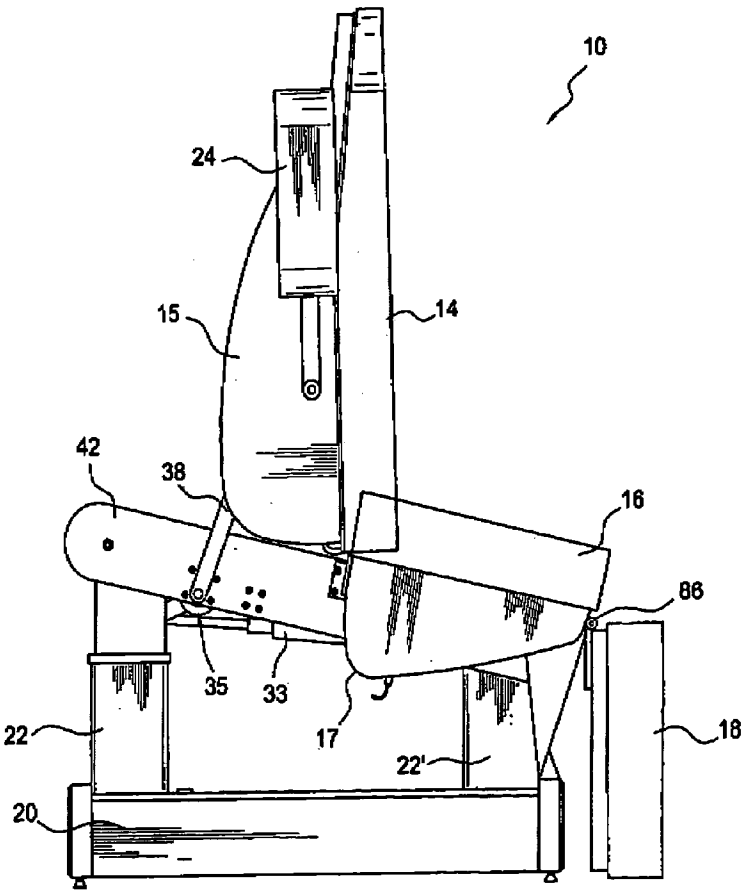
FIG. 6 is also a side profile view of the articulating table in the chair configuration in a leaning forward position to facilitate exiting by the client.

FIG. 6 shows the articulating table 10 of FIG. 5 which has been tilted forward by extension of the lifting device 22 so that the rear of the seat section 16 of the articulating table 10 is lifted to a higher elevation than that of the front of the seat section 16. As can be appreciated, this facilitates the ability for the client to sit down onto the articulating table 10 in the chair configuration shown, or to exit from the sitting position. For example, if the client has injured his/her back, it may be difficult for the client to sit on the articulating table 10 even when in the chair configuration. Correspondingly, the articulating table 10 can be tilted even in the chair configuration to facilitate ingress and egress. Moreover, once seated, the articulating table 10 can further be configured into a variety of different positions so as to facilitate rendering of proper services, for example, into the flat table configuration shown in FIGS. 1 and 2.

Figure 7:
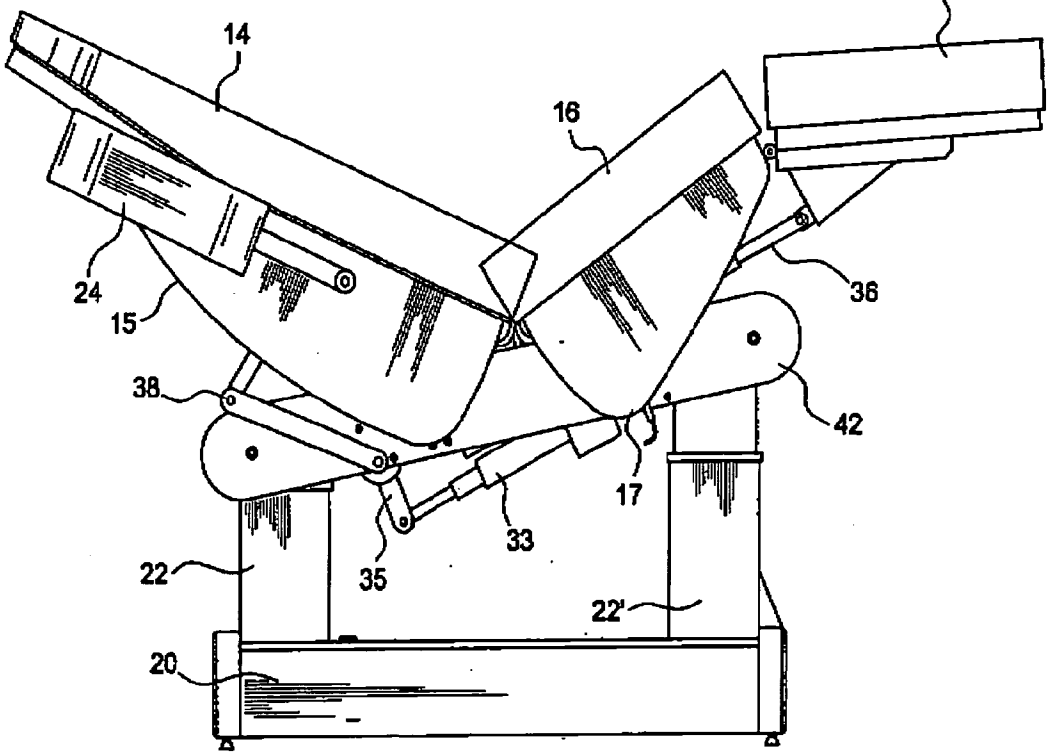
FIG. 7 is the articulating table of FIG. 1 in the reclined, feet elevated, configuration.

FIG. 7 shows the articulating table 10 from the present invention which is configured into a reclining, feet elevated, position. As can be seen, the lifting device 22' that is proximate to seat section 18 is elevated higher that the lifting device 22 so that the frame members 42 are angled relative to the base 20. In addition, the actuator 33 is only extended partially so that the back rest 14 section is at a slight incline to elevate the head and torso of the client. Furthermore, the actuator 36 that supports the foot rest section 18 is partially extended so that it is slightly angled relative to the base 20. Moreover, in this configuration, the seat section 16 is substantially inclined by actuation of the actuator 34 which is not shown in FIG. 7.

Figure 8:
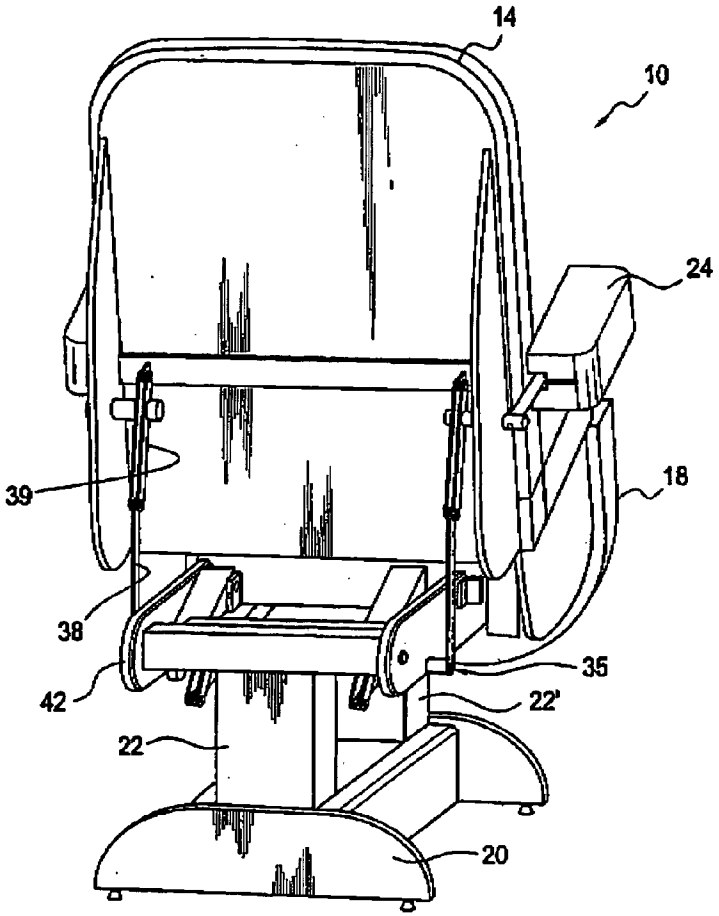
FIG. 8 shows a back perspective view of the articulating table in the chair configuration.
Figure 9:
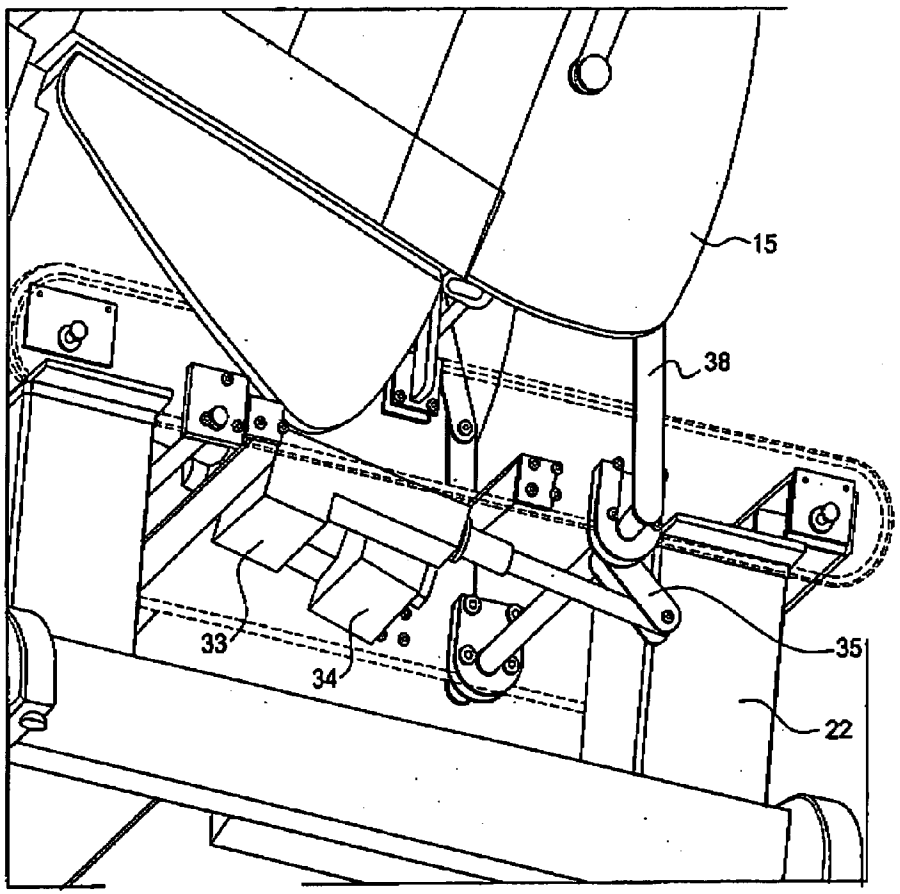
FIG. 9 shows in an enlarged perspective view of the articulation mechanisms for configuring the articulating table to the chair configuration as shown in FIG. 4.

FIG. 8 shows the back perspective view of the articulating table 10 in accordance with the present invention that has been configured into the chair configuration. As can be seen, the back rest section 14 of the articulating table 10 is erected in the manner shown by the crank mechanism 35 which rotates the rod 38 to erect the back rest section 14. The details of the articulation mechanism 30 is shown in FIG. 9 which shows an enlarged view of various components when the articulating table 10 is in the chair configuration shown in FIGS. 4 and 5. As can be seen, the actuator 33 rotates the crank mechanism 35 when extended, such that the rod 38 is correspondingly rotated. The rod 38 is connected to the link 39 that is correspondingly pivotably attached to the back rest section 14 so that the back rest section 14 is erected in the manner shown upon extension of the actuator 33. Of course, the details of the articulation mechanism 30 as described relative to FIG. 9 is only provided as one example, and may be implemented in a different manner in alternate embodiments of present invention. For example, the described crank mechanisms may be replaced with other mechanisms such as levers, cams, ratchet/pawl, or even other actuators, etc. However, the use of the described crank mechanism has been found to be efficient and cost effective.

Figure 10:
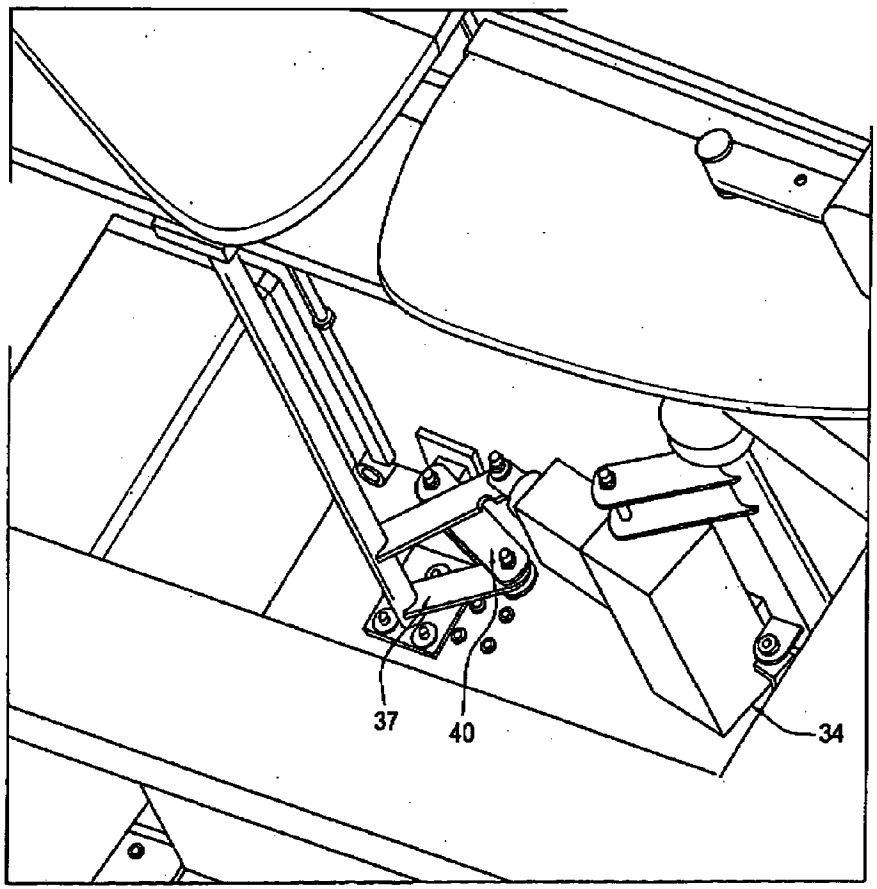
FIG. 10 shows an enlarged view of the articulation mechanism when the articulating table is in the table configuration of FIG. 1 (with certain components removed).

In a similar manner, FIG. 10 shows the actuator 34 and the crank mechanism 37 that are adapted to properly position the seat section 16 in the various configurations of the articulating table 10. In this regard, the crank mechanism 37 is connected to the connecting link 40, which is pivotably secured to the seat section 16. Upon extension of the actuator 34, the crank mechanism 37 is rotated so that the connecting link 40 is pushed upward, thereby elevating one edge of the seat section 16. This allows the seat section 16 to be configured substantially flat relative to the frame members 42 as shown in FIGS. 1,2 and 6, or with the front edge of the seat section 16 angled as shown in FIGS. 5 and 7. Again, the articulation mechanism 30 shown in FIG. 10 is merely one example implementation, and in other embodiments of the present invention, the articulation mechanism 30 may be implemented differently.

Figure 11:
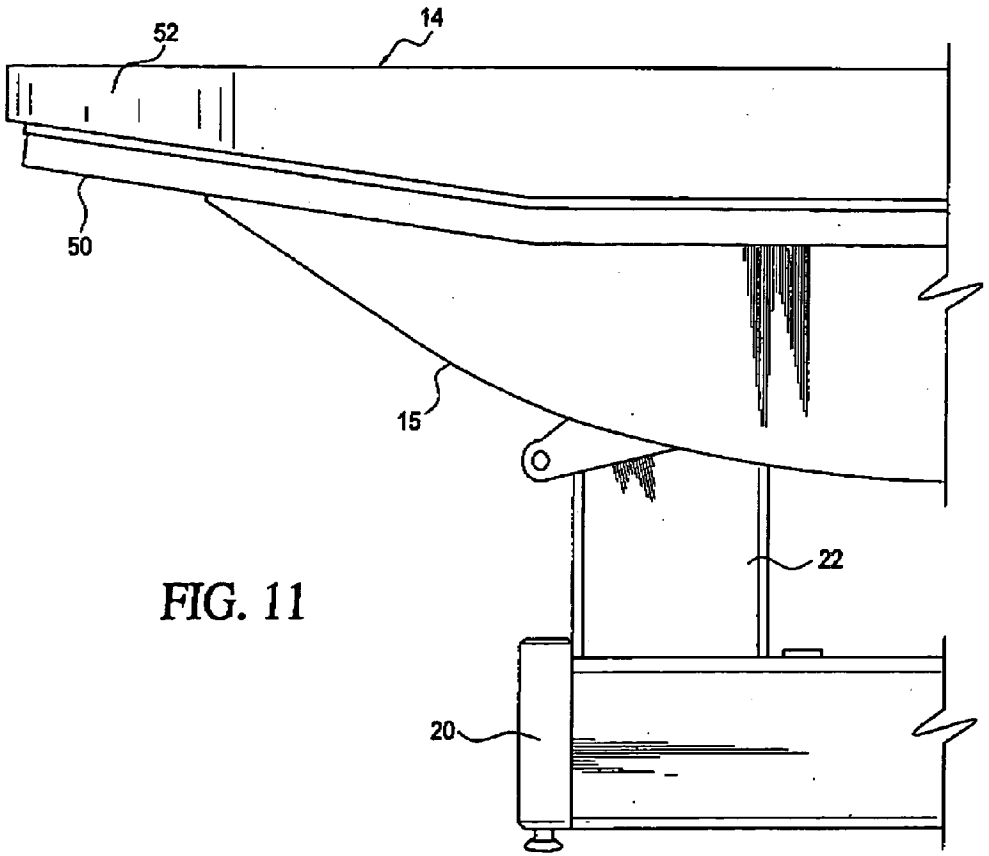
FIG. 11 shows a side profile view of the tapered foam and the angled table top frame in accordance with one embodiment of the present invention.

FIG. 11 shows another aspect of the articulating table 10 in accordance with the illustrated embodiment of the present invention. In particular, as can be seen, the back rest section 14 is provided with an angled support surface 50 which is inclined slightly toward the end where the client's head would rest as compared to the rest of the back rest section 14. In this regard, as can also be seen, the cushion 52 for the back rest section 14 is tapered on one side to correspond with the angled support surface 50 and has a substantially planar flat surface on an opposite side thereof for supporting the client comfortably.

Figure 12:
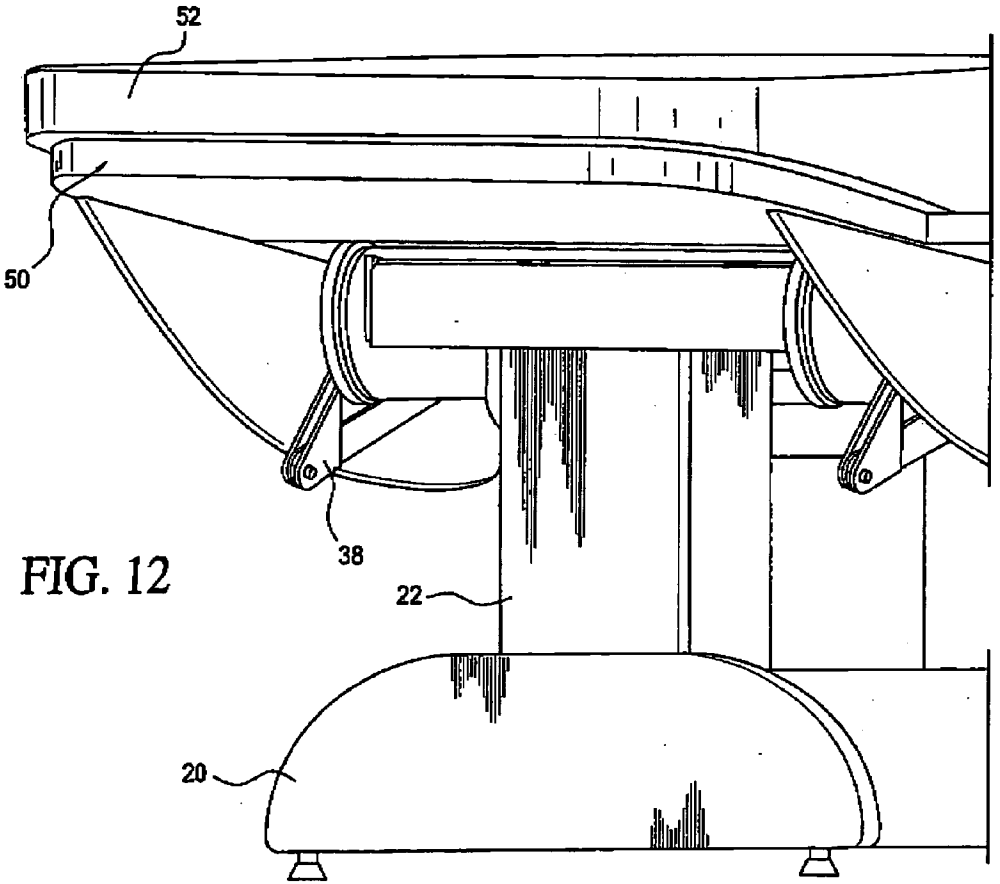
FIG. 12 shows an enlarged perspective view of the tapered foam and angled table top frame as shown FIG. 11.

The angled support surface 50 allows the therapist or other individuals providing services to the client laying on top of the articulating table 10, to easily access the head and shoulder region of the client. In this regard, the angled support surface 50 allows the therapist or other professional to sit with his/her knees tucked underneath the angled support service 50 of the back rest section 14 such that the head/shoulders of the client can be easily and ergonomically reached, without having to over extend/reach or lean over the client. FIG. 12 shows a perspective view of the back rest section 14 which clearly shows the angled support surface 50 that provides sufficient space for the knees of therapist or other professional to be tucked there under. In addition, FIG. 12 further shows the tapered cushion 52 provided on the back rest section 14. The angled support surface 50 also allows the articulating table 10 to be positioned lower with the individual's knees tucked thereunder than otherwise be possible if the back rest section 14 was of constant thickness. This facilitates a more ergonomic position for the therapist or other professional when rendering his/her services.

Figure 13:
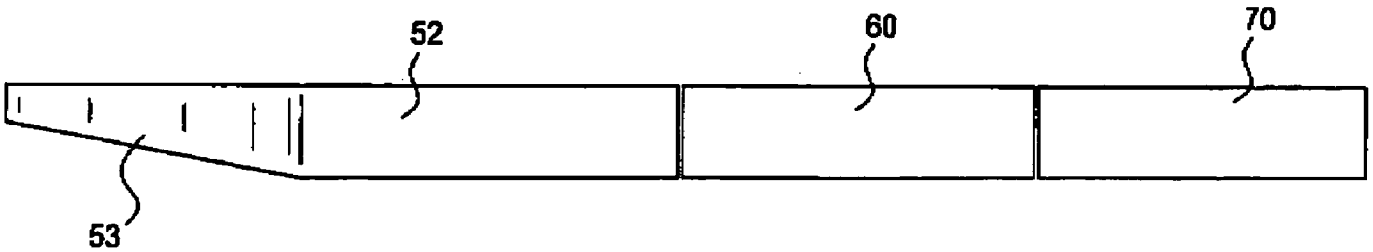
FIG. 13 shows the side profile views of the cushions of the sections of the table top.

FIG. 13 shows a side profile view of the cushions for use with the articulating table in accordance with the illustrated embodiment. In particular, FIG. 13 shows the back rest cushion 52 discussed above which is provided with the tapered portion 53, the seat cushion 60, and the foot cushion 70. These cushions are secured to the back rest section 14, the seat section 16, and the foot rest section 18, respectively, to thereby provide a comfortable support surface for the client, whether the articulating table is utilized as a table, a chair, or a recliner as described above. The cushions may be made of any appropriate material(s) including foam, sponge, etc. and is preferably covered with a durable covering made of fabric, vinyl, leather, or other materials.

Figure 14:
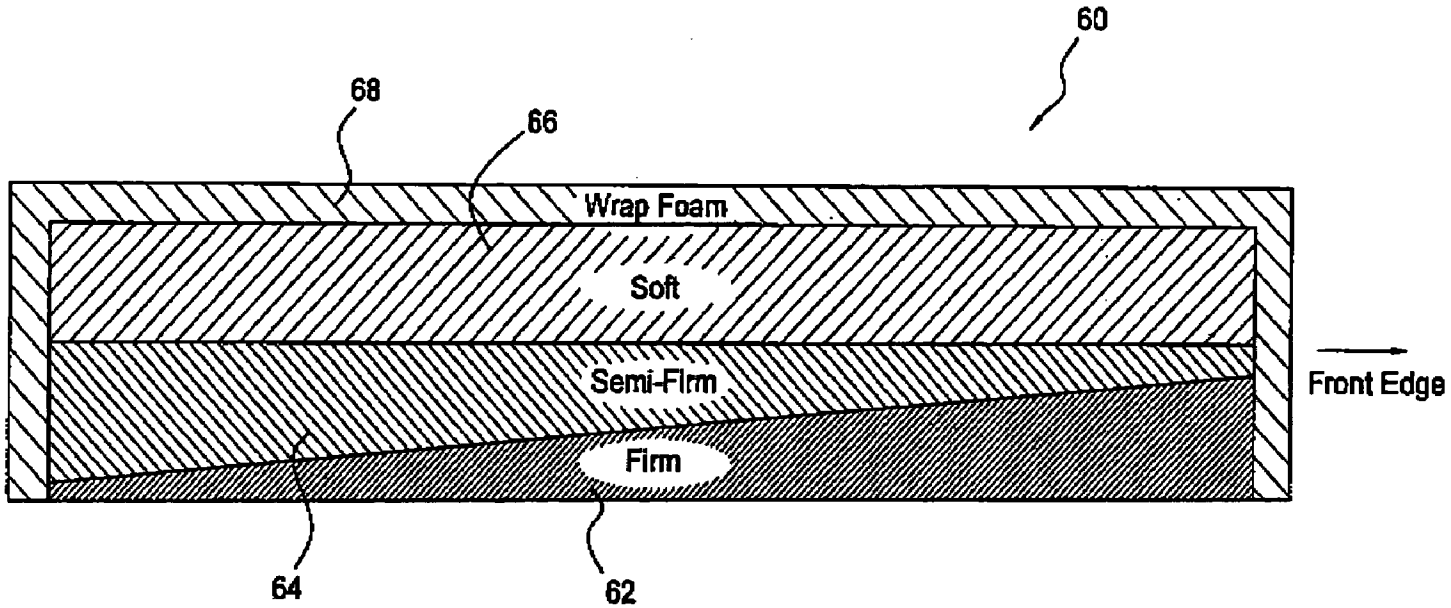
FIG. 14 shows the cross sectional view of the foam for the seat cushion of the articulating table in accordance with one example of embodiment.

FIG. 14 shows a cross-sectional view of one specific embodiment of the seat cushion 60 in accordance with another aspect of the present invention. In particular, the seat cushion 60 is implemented with plurality of different layers that have different firmnesses and shape. In particular, as can be seen in FIG. 14, the seat cushion includes a firm layer 62 that has a wedge profile, the thicker portion of the firm layer 62 being positioned toward the front edge of the seat section 16 which is positioned below the knees of the client when sitting thereon. An inverted wedge shaped semi-firm layer 64 is provided on top of the firm layer 62. A soft layer 66 is then provided on top of the semi-firm layer 64 to enhance comfort, and a wrap foam layer 68 encompasses the various layers of the seat cushion 60 together. Of course, a durable cover made of vinyl or other material may be provided as well in the manner noted. This multi-layer implementation of the seat cushion 60 for the seat section 16 helps the client from slipping forward or slouching when in the seated position. Because the lowest layer of the seat cushion 60 is wedge shaped with increasing thickness towards the front edge of the seat section 16, the angle of the seat section 16 relative to the horizontal plane is functionally changed while allowing the overall seat cushion 60 to have a substantially constant thickness overall.

Figure 15:
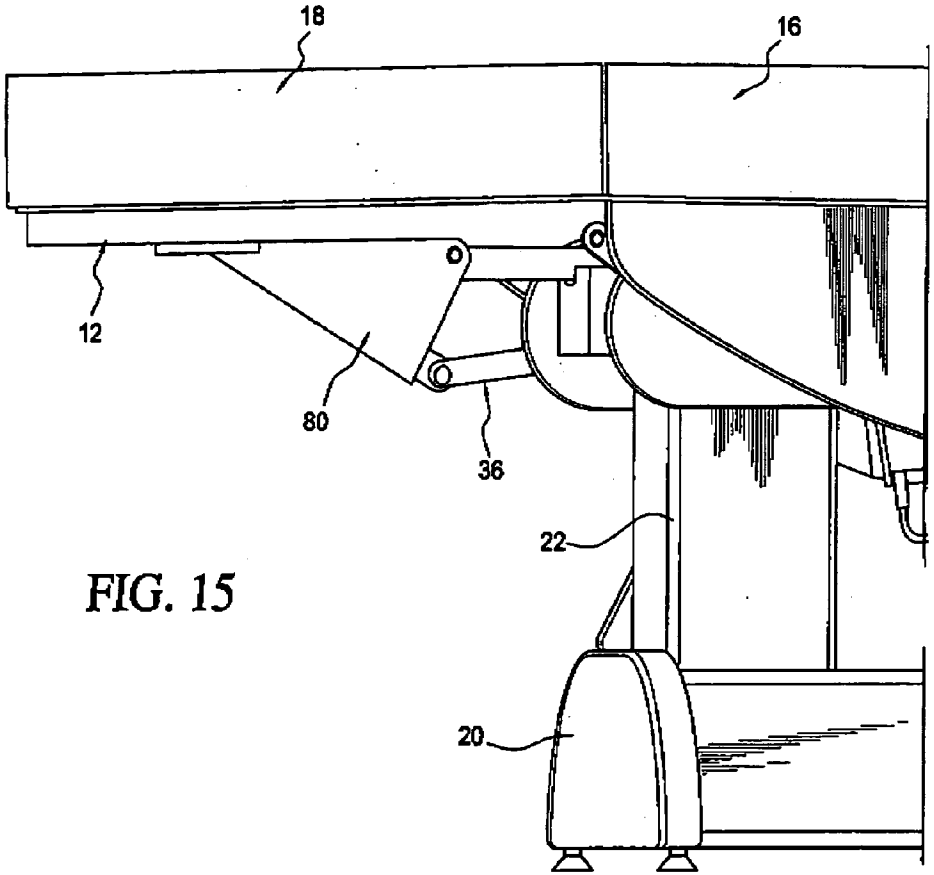
FIG. 15 shows a side perspective view of the foot rest.

FIG. 15 shows the foot rest section 18 of the articulating table 10 of FIG. 1. As can be appreciated, in the illustrated configuration, the foot rest section 18 is elevated via the actuator 36 that has been extended so that the foot rest section 18 is substantially coplanar with the seat section 16. In this regard, the foot rest section 18 is supported by support member 80 via the table top frame 12. The support member 80 is preferably not directly secured to the table top frame 12 of the foot rest 18 as further described below. In addition, as also can be seen, because of the cantilevered implementation of the foot rest 18, the therapist or other professional is provided with facilitated access underneath the foot rest section 18 such that his/her knees or legs can be positioned under the foot rest section 18. This allows ergonomic positioning for facilitated access to the client's feet region without over reaching or bending over. Moreover, the actuator 36 in conjunction with the support member 80 are preferably implemented to be sufficiently strong enough to support the load rating of the articulating table 10.

Figure 16:
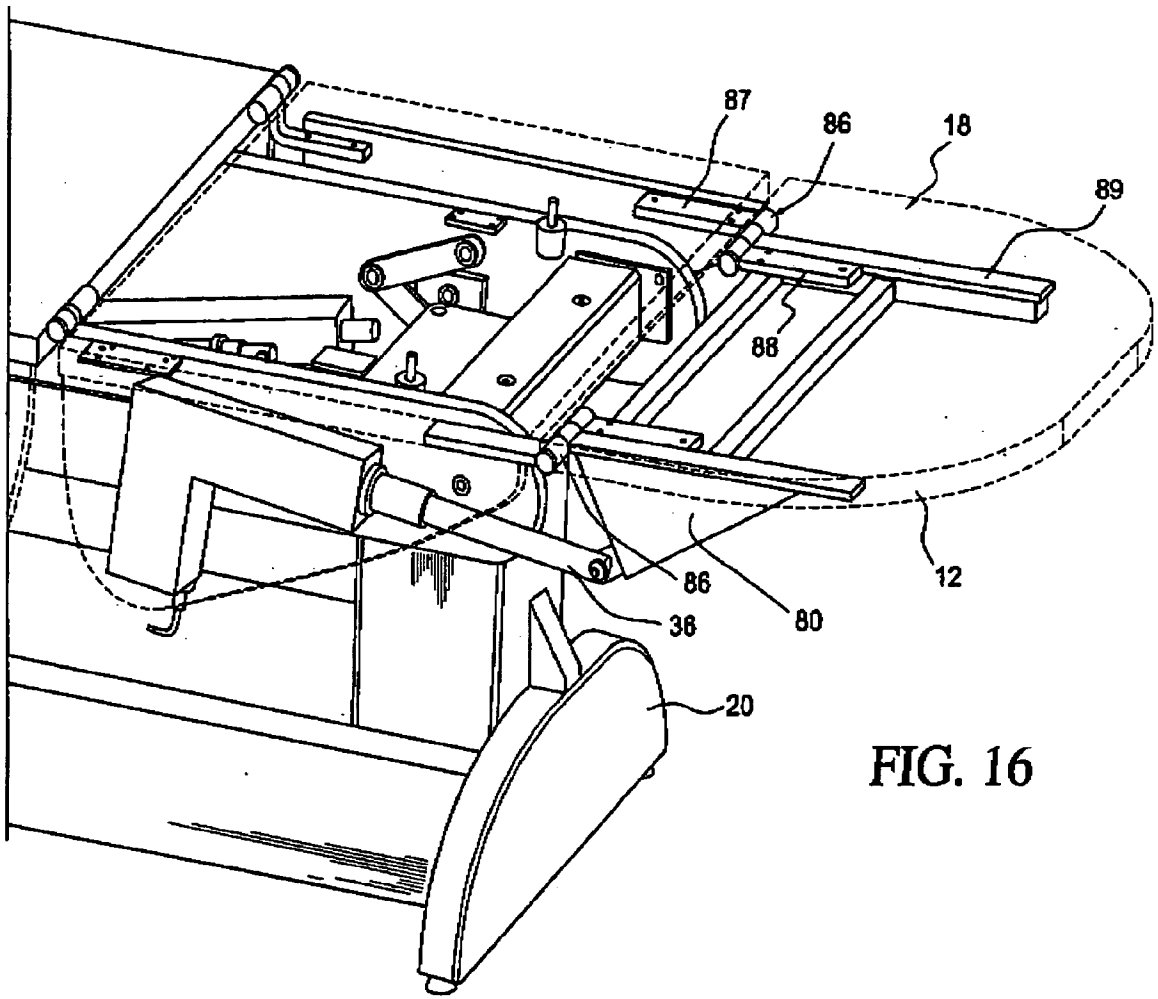
FIG. 16 shows side perspective views and various components associated with foot rest mechanism in accordance with one example embodiment of the present invention.

FIG. 16 shows the articulation mechanism for the foot rest section 18 of the articulating table 10 in accordance with one preferred embodiment of the present invention with the cushion removed. The seat and foot rest sections are transparently shown so that various components of the articulation mechanism can be clearly seen. As shown, the actuator 36 is connected to the support member 80. However, the support member 80 is not directly connected to the foot rest 18. Instead, the double hinges 86 are provided in which a first flange 87 is connected to the table top frame of the seat section 16, a second flange 88 is connected to the table top frame of the foot rest section 18, and the third flange 89 is connected to the support member 80, which in turn, is connected to actuator 36 by the support member 80. Thus, when the actuator 36 is retracted, the foot rest section 18 pivots about the hinge 86 to pivot downward into a substantially vertical position. However, because the foot rest section 18 is not directly attached to actuator 36, the foot rest section 18 can pivot to other positions as well when the actuator 36 is retracted. Correspondingly, in the illustrated embodiment, the actuator 36 and the support member 80 are provided for the purpose of lifting and supporting the foot rest section 18, but do not pull or retract the foot rest section 18 downward. In this regard, only gravity is utilized in the present illustrated embodiment to move the foot rest section 18 to the downwardly pivoted position. This feature prevents forced interference of various mechanical components of the articulating table 10 thereby avoiding potential breakage or damage to such components as the articulating table 10 is articulated between various configurations and positions described previously, as well as other positions.

Figure 17:
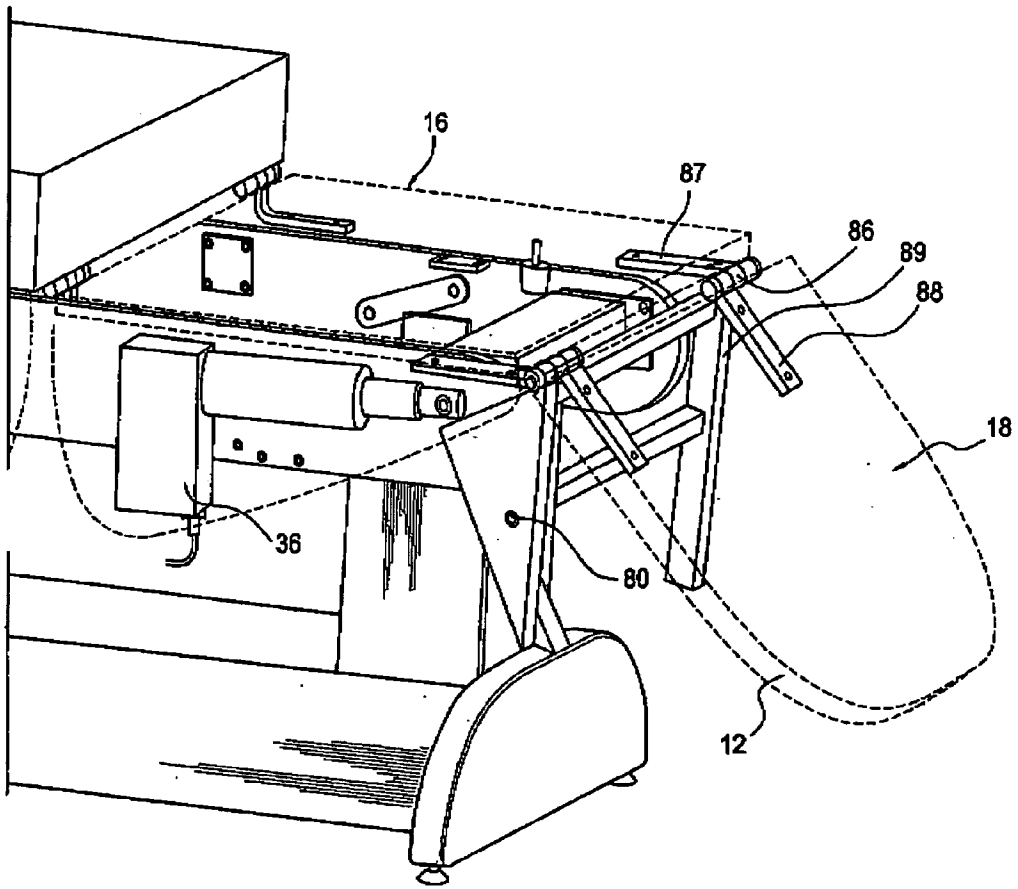
FIG. 17 shows the detail view of the hinge of the foot rest mechanism of FIG. 16.
Figure 18:
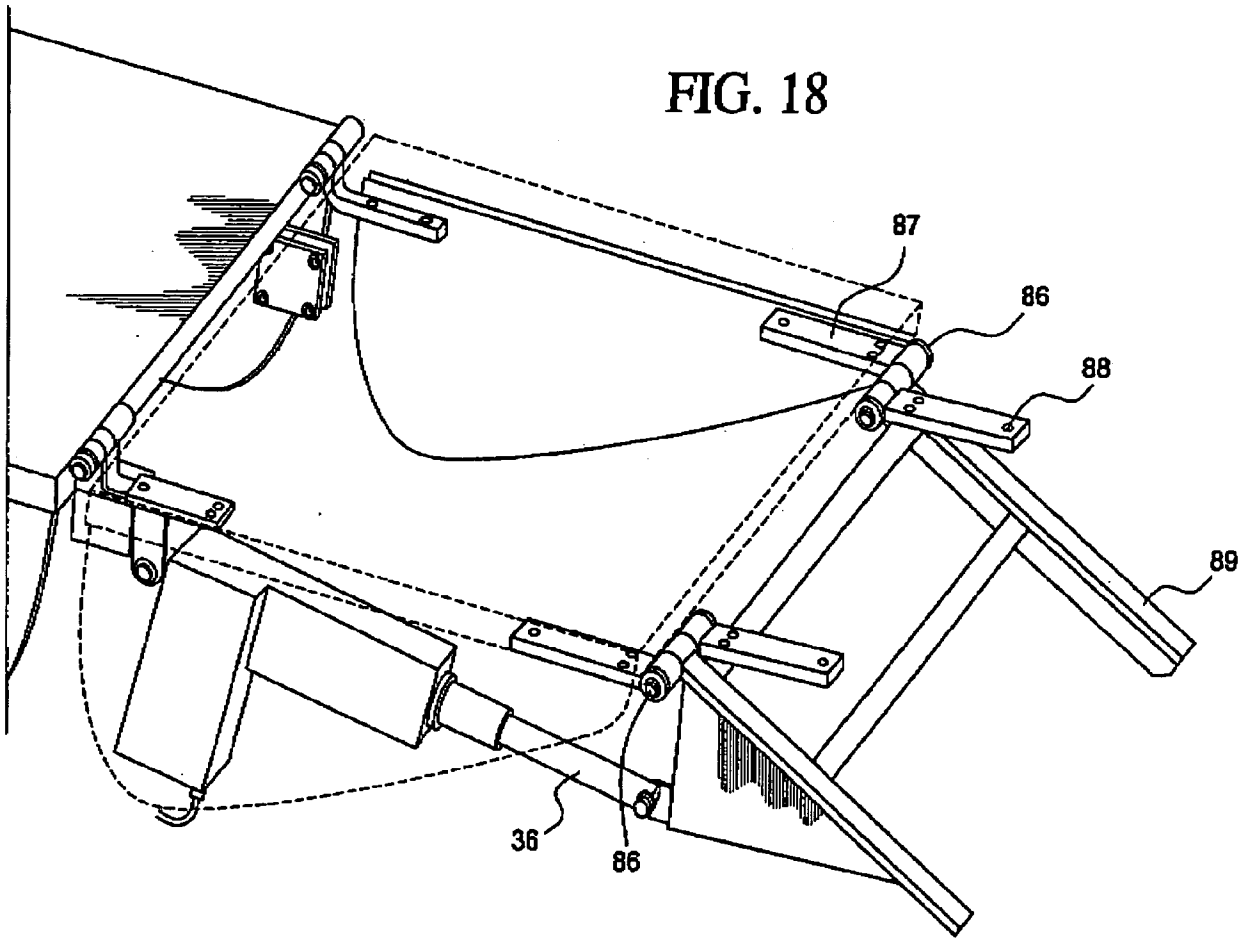
FIG. 18 shows the hinge of FIG. 17, without the foot rest section of the articulating table.

FIGS. 17 and 18 further illustrate operation of the double hinges 86 described above relative to FIG. 16. In these figures, the cushions for the seat section 16 and the foot rest section 18 are removed and various components are illustrated as being transparent for clarity. As can be seen, flanges 87 and 88 pivotally secure the foot rest section 18 of the articulating table 10 to the seat section 16. Flange 89 of the double hinges 86 are not secured to the foot rest section 18 at all, but are connected to the support member 80 to merely support the foot rest section 18 so that the foot rest section 18 can be pivoted or otherwise lifted by the actuator 34. Thus, the foot rest section 18 can be pivoted to an angled position as shown in FIG. 17, even when the actuator 36 is in the fully retracted position as shown.

The importance of the above noted feature can be recognized by comparing. FIG. 5 and FIG. 6 which show two different positions of the articulating table 10 when in the chair configuration. As shown in FIG. 5, the foot rest section 18 is angled downwardly with the corresponding actuator 36 for the foot rest section 18 being fully retracted. By further positioning the articulating table 10 to the position shown in FIG. 6 in which the chair configuration is tilted forward, it can be seen that the foot rest section 18 is maintained at a substantially vertical hanging position, since it is not attached to the support member 80. Otherwise, if the foot rest section 18 was secured and directly connected to the support member 60 and/or the actuator 36, the foot rest section 18 will abut against the base 20 and/or lifting device 22' such that the tilting of the seat configuration as shown in FIG. 6 would not be possible and/or damage to the actuator 36 and/or the foot rest section 18 would result.

Figure 19:
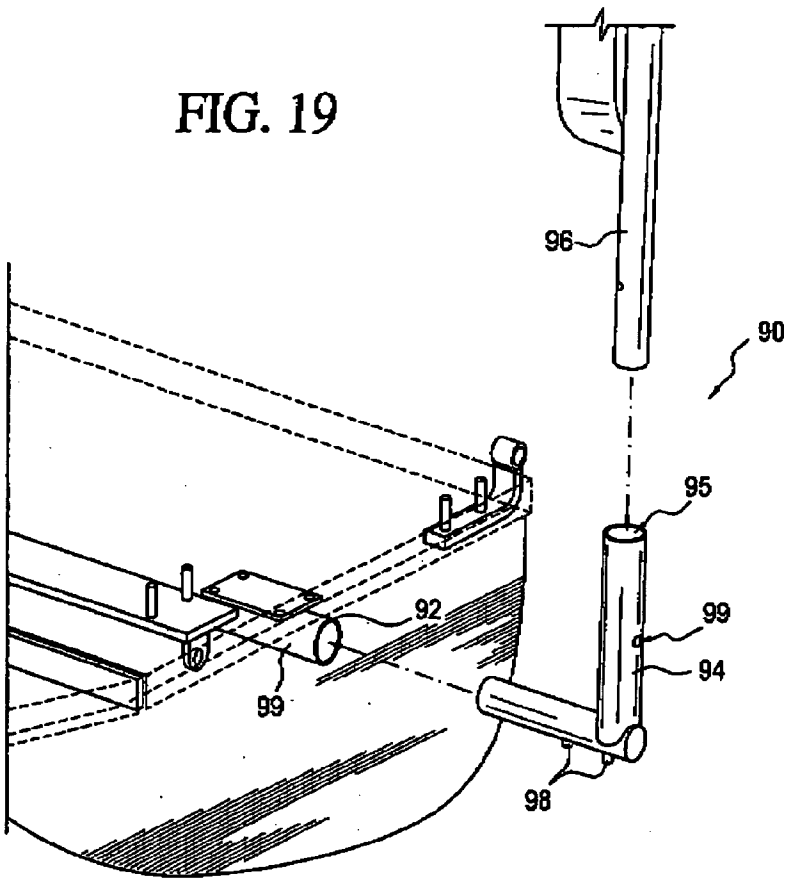
FIG. 19 shows mechanism for mounting the arm rest in accordance with one example of embodiment of the articulating table.

The arm rest 24 of the articulating table 10 is preferably implemented to be pivoted between a use position and a stored position, and is further implemented to be rotated between narrow, wide and high positions. FIG. 19 shows an unassembled view of the arm rest support structure 90 in accordance with one example implementation which may be used with the articulating table 10 shown in FIG. 1. As described in detail below, the arm rest support structure 90 comprises a plurality of components, that together, allow the arm rest 24 to adjusted to a variety of different positions to enhance the functionality of the articulating table 10. In this regard, the arm rest support structure 90 includes a mounting bracket 92 that is secured to the back rest section 14 of the articulating table 10. The mounting bracket 92 is adapted to receiving an adapter bracket 94. The adapter bracket 94 includes a receiver opening 95 sized to receive an arm rest pad support 96. The adapter bracket 94 and the arm rest pad support 96 are provided with release buttons 98 which engage button holes 99 provided on the mounting bracket 92 and the adapter bracket 94. The release buttons 98 may be spring-loaded so as to engage the button holes 99 upon proper alignment.

Figure 20:
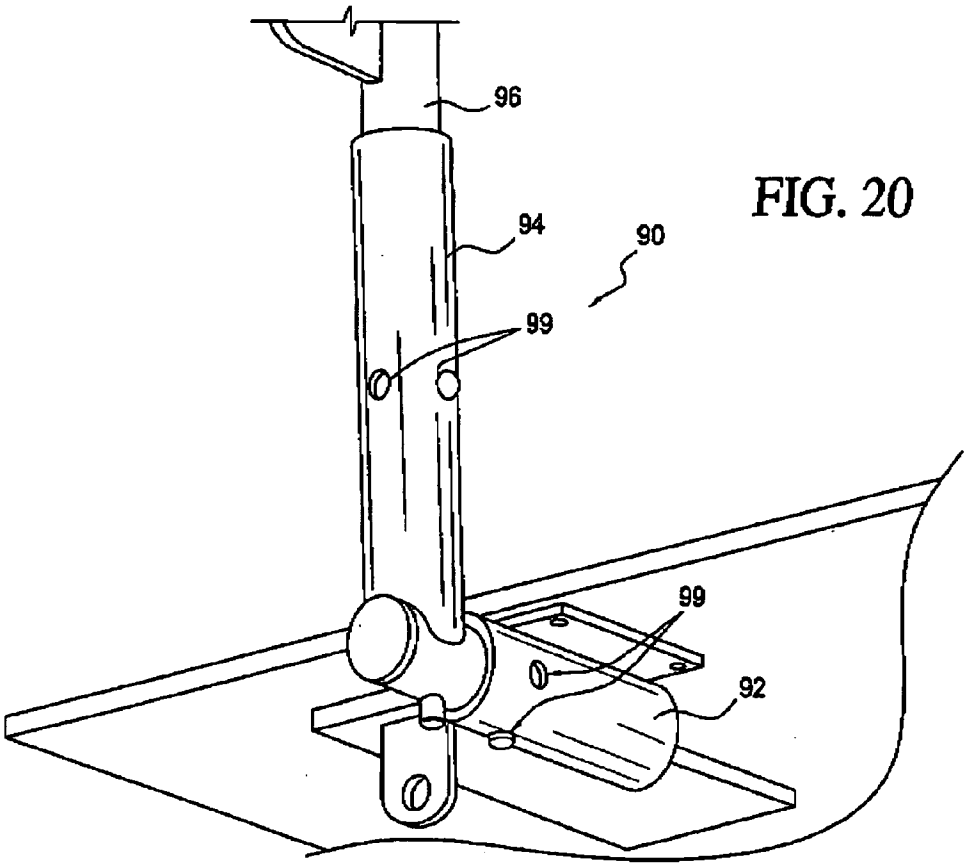
FIG. 20 shows an enlarged view of arm rest mechanism having housed that allow rotation of the arm rest in accordance with the embodiment of the present invention.

The button holes 99 are provided in various locations to allow adjustment of the positions of the adapter bracket 94 and the arm rest pad support 96. In this regard, FIG. 20 shows an enlarged assembled view of the arm rest support structure 90. As can be seen, the mounting bracket 92 is provided with two button holes 99 for allowing pivot of the adapter bracket 94 into the storage position, and the use position shown where the arm rest support structure 90 is perpendicular to the back rest section 14. In addition, the adapter bracket 94 itself is provided with button holes 99 (only two being shown) that allow rotation of the arm rest pad support 96 to various positions including narrow position, wide position, and high position. Thus, by rotating the adapter bracket 94 relative to the mounting bracket 92, the above described arm rest support structure 90 allows the arm rest 24 to be pivoted between a storage position in which arm rest 24 are flat and parallel to table top frame 12 as shown in FIG. 1, and a use position in which the arm rest 24 is substantially perpendicular to the back rest section 14 as shown in FIG. 4, so that the client can comfortably rest his/her arms when sitting in the articulating table 10 that has been configured into the chair configuration.

Figure 21:
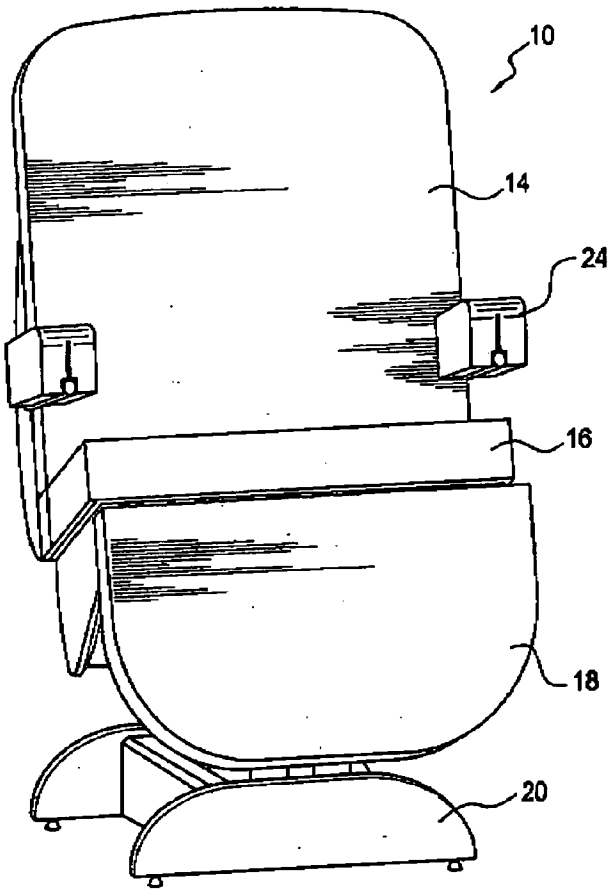
FIG. 21 shows the articulating table in the chair configuration as shown in FIG. 4, but with the arm rest in a different position.
Figure 22:
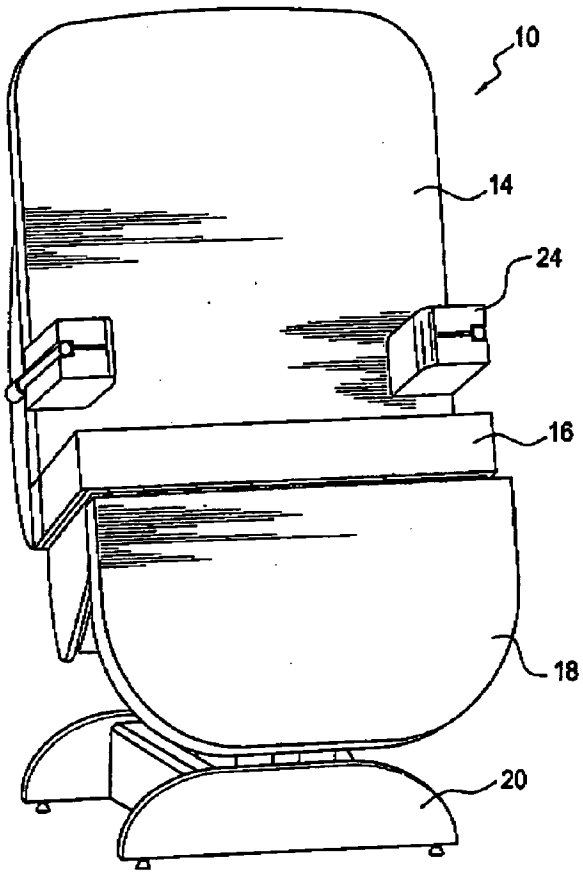
FIG. 22 shows the articulating table in the chair configuration shown in FIG. 4, but with the arm rest in yet another position.
Figure 23:
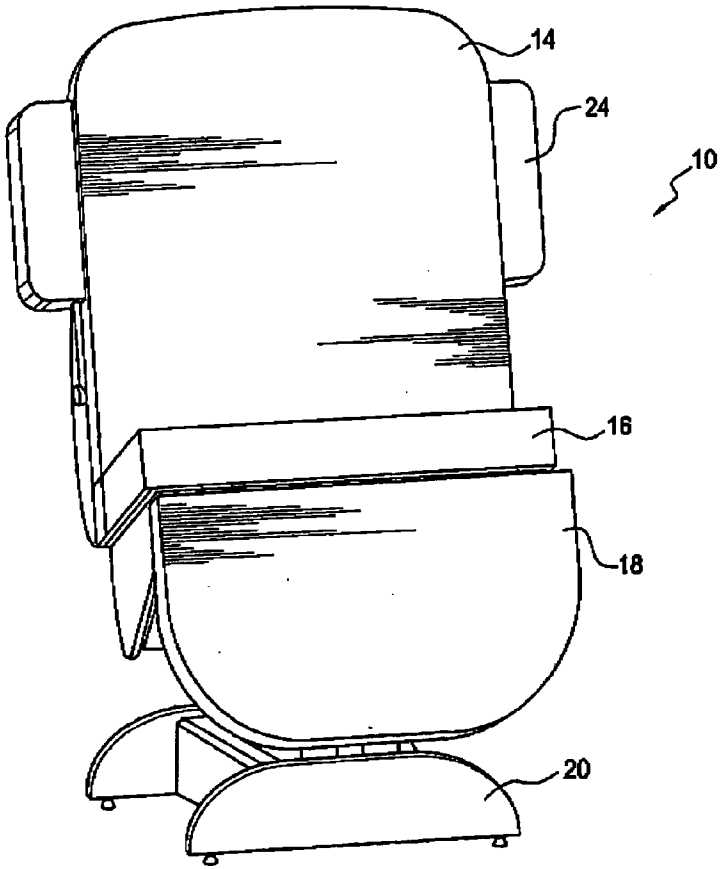
FIG. 23 shows the articulating table in the chair configuration shown in FIG. 4, but with the arm rest being in retracted position.

Referring to FIG. 4, the arm rests 24 have been placed in the wide configuration in which the arm rest pad support 96 extend outwardly of the articulating table 10. In contrast, referring to FIG. 21, the arm rest pad support 96 is rotated in the receiver opening 95 of the adapter bracket 94 to be upward so that the arm rests 24 are in the high position. FIG. 22 shows the position of the arm rest 24 upon further rotation of the arm rest pad support 96 in the adapter bracket 94 so that the arm rests 94 are in the narrow position where the arm rest pad support 96 extend inwardly. Finally, FIG. 23 shows the arm rests 24 which have been moved into the storage position by pivoting the adapter bracket 94 within the mounting bracket 92 thereby providing a chair configuration without arm rests.

The above flexibility in configuring the arm rests in a variety of different positions allows the articulating table 10 to be adjusted according to the physical characteristics of the client when used in the chair configuration discussed above. Of course, it should be appreciated that the button and button holes implementation of the arm rest and the various components thereof as discussed in detail above are merely one example implementation and the present invention is not limited thereto. The arm rest can be movably secured to the articulating table 10 in any other appropriate manner, for example, using threaded set screws, wing nuts, lock nut, etc.

Thus, the present invention provides a combination of a flat table that may be reconfigured into an upright chair or a recliner, in a single unit. As described, the table top may be comprised of three sections which are each angularly adjustable via electric actuators, or in alternative implementations, manual mechanisms or with hydraulic or pneumatic actuators. Height adjustability and features of the back rest section provides added ergonomic improvement, and the features of the seat section provides improved support to the client. Because the articulating table can assume positions that range from a largely upright chair to completely planar table, the client is able to sit on the table when in the chair configuration, lie down for treatment, and return to an upright chair position for exiting. The plurality of positions also possible provide improved ergonomics to therapists or other professionals.

While various embodiments in accordance with the present invention have been shown and described, it is understood that the invention is not limited thereto. The present invention may be changed, modified and further applied by those skilled in the art. Therefore, this invention is not limited to the detail shown and described previously, but also includes all such changes and modifications.

We claim:

1. An articulating table that is configurable between a substantially flat table configuration and a chair configuration comprising:

a back rest section;

a seat section;

at least one hinge that pivotally connects the back rest section and the seat section, so that the back rest section and the seat section are pivotable about the at least one hinge;

a base with a vertically extending first lifting device and a vertically extending second lifting device that are controllable to adjust at least one of height position and incline of the articulating table, said first and said second lifting devices being operable to extend vertically upwardly and downwardly; and an articulation mechanism with a frame member positioned and extending longitudinally underneath the back rest section and the seat section, the first lifting device being connected to the frame member proximate to one end, end the second lifting device being connected to the frame proximate to another end, difference between amount of extensions of the first lifting device and the second lifting device adjusting the incline of the articulating table;

wherein the articulation mechanism includes at least one actuator that is operable to adjust the position of at least the back rest section and the seat section to configure the table between the substantially flat table configuration and the chair configuration; and wherein the back rest section includes a table top frame having an angled support surface, and a cushion that is supported on the table top frame, the cushion having a tapered portion which is tapered on one side along its thickness dimension to correspond to the angled support surface and having a substantially planar flat surface on an opposite side thereof for supporting a user, the tapered portion of the cushion being supported by the angled support surface.

2. The table of claim 1, wherein said at least one hinge is fixedly secured to the frame member.

3. The table of claim 1, further including a foot rest section, and at least one hinge that pivotally connects the foot rest section to the seat section so that the foot rest section is pivotable about the at least one hinge.

4. The table of claim 3, wherein said at least one hinge that pivotally connects the foot rest section to the seat section is a double hinge that includes a first flange connected to the seat section, a second flange connected to the foot rest section, and the third flange connected to the support member.

5. The table of claim 4, wherein the at least one actuator of the articulation mechanism includes a foot rest actuator and a support member connected to the foot rest actuator, the support member supporting the foot rest section when the foot rest actuator is extended.

6. The table of claim 5, wherein the foot rest section is not directly attached to the support member and the foot rest actuator.

7. The table of claim 4, wherein the first, second and third flanges of the double hinge are pivotably connected by a common pin.

8. The table of claim 1, wherein the seat section includes a seat cushion having a plurality of layers that includes a wedge profiled layer, the wedge profiled layer being thicker toward an edge of the seat cushion opposite to the back rest section, and thinner toward an edge of the seat cushion adjacent to the back rest section, the wedge profiled layer being the firmest layer of the plurality of layers, and the plurality of layers also including an inverted wedge profiled layer, the wedge profiled layer being thicker toward an edge of the seat cushion adjacent to the back rest section.

9. The table of claim 1, further including arm rests that are rotatable between a wide configuration and a high configuration.

10. An articulating table that is configurable between a substantially flat table configuration and a chair configuration, and further positionable in a leaning forward position in the chair configuration, the table comprising:

a back rest section;

a seat section;

at least one hinge fixedly secured to the frame member that pivotally connects the back rest section and the seat section, so that the back rest section and the seat section are pivotable about the at least one hinge;

a foot rest section;

a double hinge that pivotally connects the foot rest section to the seat section, the double hinge including a first flange connected to the seat section, a second flange connected to the foot rest section, and the third flange connected to a support member that supports the foot rest section, but is not attached to the foot rest section so that said foot rest section is pivotable off of said support member about said double hinge when the articulating table is positioned in a leaning forward position in the chair configuration;

a base with a first lifting device and a second lifting device; and an articulation mechanism with a frame member positioned underneath at least the back rest section and the seat section, the first lifting device connected to the frame member proximate to one end of the frame member, and the second lifting device proximate to another end of the frame member;

wherein the articulation mechanism is operable to adjust the position of at least the back rest section and the seat section to configure the table between the substantially flat table configuration and the chair configuration; and wherein the first, second and third flanges of the double hinge are pivotably connected by a common pin.

11. The table of claim 10, wherein the first lifting device and the second lifting devices are controllable to adjust at least one of height position and incline of the articulating table, the first and the second lifting devices being operable to extend vertically upwardly and downwardly.

12. The table of claim 10, wherein the back rest section includes a table top frame having an angled support surface, and a cushion that is supported on the table top frame, the cushion having a tapered portion which is tapered on one side to correspond to the angled support surface and having a substantially planar flat surface on an opposite side thereof for supporting a user, the tapered portion of the cushion being supported by the angled support surface.

13. The table of claim 10, wherein the seat section includes a seat cushion having a plurality of layers that includes a wedge profiled layer, the wedge profiled layer being thicker toward an edge of the seat cushion opposite to the back rest section, and thinner toward an edge of the seat cushion adjacent to the back rest section, the wedge profiled layer being the firmest layer of the plurality of layers, and the plurality of layers also including an inverted wedge profiled layer, the wedge profiled layer being thicker toward an edge of the seat cushion adjacent to the back rest section.

14. The table of claim 10, further including arm rests that are rotatable between a wide configuration and a high configuration.

* * * * *